US007610885B2

(12) United States Patent
Stueckrad et al.

(10) Patent No.: US 7,610,885 B2
(45) Date of Patent: Nov. 3, 2009

(54) VARIABLE DRIVE FOR CAMSHAFTS

(75) Inventors: Rainer Stueckrad, Alheim Baumbach (DE); Stefan Malm, Melsungen (DE); Helmut Straub, Rotenburg (DE); Walter Richter, Simbach am Inn (DE)

(73) Assignee: Neumayer Tekfor Holding GmbH, Hausach (DE)

( * ) Notice: Subject to any disclaimer, the term of this patent is extended or adjusted under 35 U.S.C. 154(b) by 84 days.

(21) Appl. No.: 12/053,179

(22) Filed: Mar. 21, 2008

(65) Prior Publication Data

US 2008/0312000 A1 Dec. 18, 2008

Related U.S. Application Data

(63) Continuation of application No. PCT/DE2006/001454, filed on Aug. 18, 2006.

(30) Foreign Application Priority Data

Sep. 23, 2005 (DE) ..... 10 2005 045 746
Feb. 18, 2006 (DE) ..... 10 2006 007 586

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,405,694 B2 * 6/2002 Sato ..... 123/90.15
6,615,487 B2 9/2003 Iwasaki et al.

FOREIGN PATENT DOCUMENTS

| | | | |
|---|---|---|---|
| DE | 197 15 308 | C2 | 6/2001 |
| DE | 101 48 687 | A1 | 6/2002 |
| DE | 10 2004 011 659 | A1 | 11/2004 |
| JP | 2002-180809 | A | 6/2002 |
| WO | WO 2004/089574 | A1 | 10/2004 |

* cited by examiner

*Primary Examiner*—Ching Chang
(74) *Attorney, Agent, or Firm*—Crowell & Moring LLP

(57) ABSTRACT

A rotor (2) and/or rotor housing (1) for a camshaft adjuster for a motor vehicle engine and a method for manufacturing the same.

8 Claims, 1 Drawing Sheet

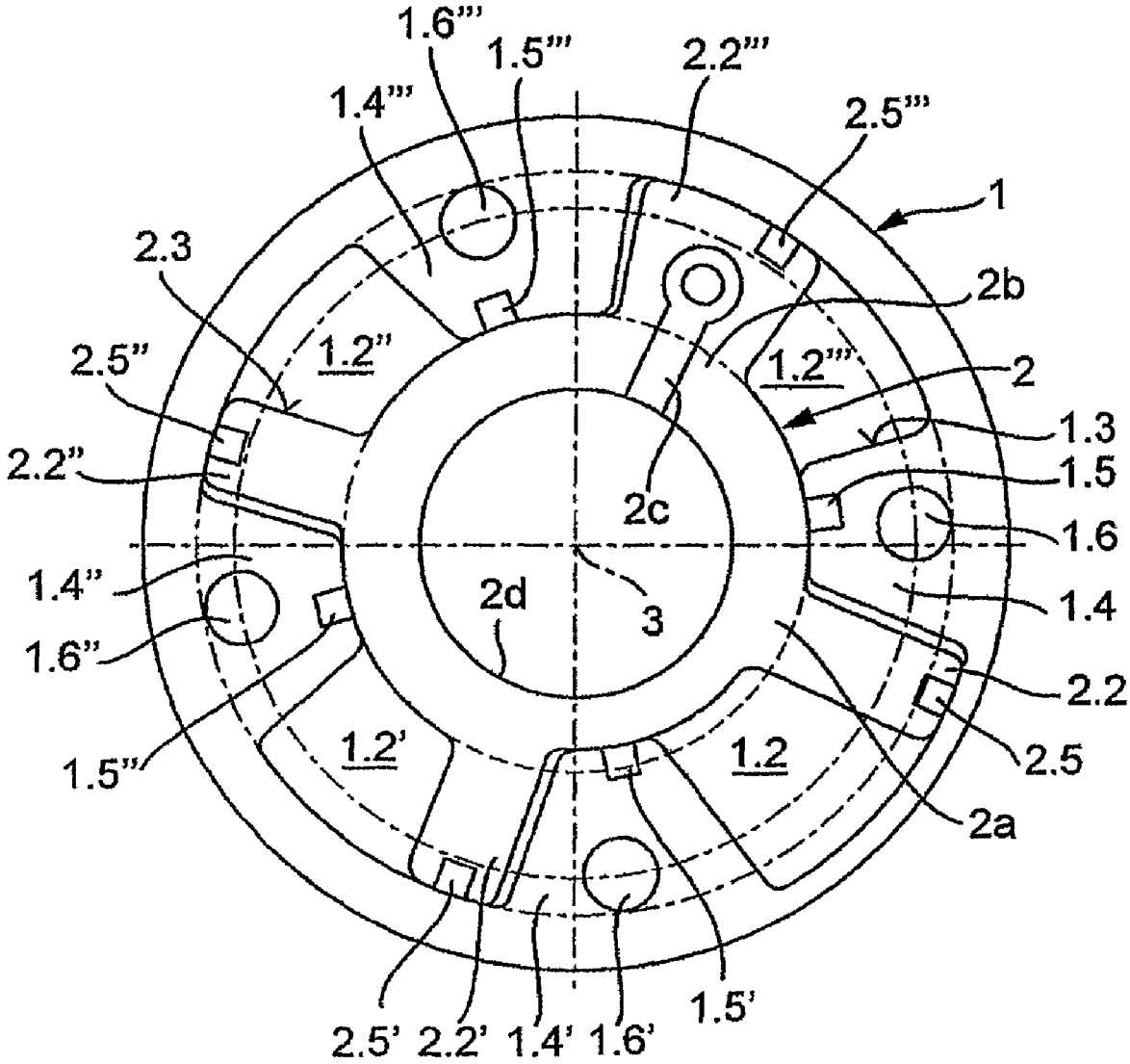
1.6'''
1.5'''
2.2'''
1.4'''
2.5'''
1
2.3
2b
2.5"
1.2"
1.2'''
2
1.3
2.2"
1.5
2c
1.6
1.4"
2d
3
1.4
1.6"
2.2
1.5"
1.2'
1.2
2.5
2a
2.5'
2.2'
1.4'
1.6'
1.5'

VARIABLE DRIVE FOR CAMSHAFTS

CROSS REFERENCE TO RELATED APPLICATIONS

This application is a continuation of international patent application no. PCT/DE2006/001454, filed Aug. 18, 2006 designating the United States of America and published in German on Mar. 29, 2007 as WO 2007/033634, the entire disclosure of which is incorporated herein by reference. Priority is claimed based on Federal Republic of Germany patent application nos. DE 10 2005 045 746.0, filed Sep. 23, 2005 and DE 10 2006 007 586.2, filed Feb. 18, 2006.

BACKGROUND OF THE INVENTION

The invention relates to components, such as rotors and/or rotor housings for a camshaft adjuster, and to methods for producing such components for motor vehicle engines, in which the rotor, with vanes that extend radially outwardly from a rotor core engages in chambers of the rotor housing formed by webs that extend radially inwardly from the outer housing wall, and the contours of at least one of the components comprise or are produced from a continuous casting or an extruded part made of a metal alloy, particularly a light metal alloy.

U.S. Pat. No. 6,615,487 (=JP 2002-180809) discloses a valve drive for a motor vehicle whose rotor and housing are made of an extruded aluminum alloy. The blank is cut to the desired length and then machined in a cutting and polishing process.

To ensure fast and cost-effective production, it has also been proposed to produce a component blank for items of the above-mentioned type by separating a, or the, continuous casting or section and, in a forming operation using a die, either before or after separation, calibrating the component to the desired dimension as described in international application no. WO 2004/089574 (=DE 10 2004 011 659).

SUMMARY OF THE INVENTION

An object of the present invention was to provide a method of producing rotors and/or rotor housings for camshaft adjusters optimally and in a cost-effective manner.

Another object was to improve the speed of production of such components.

A still further object was to integrate additional functions into the production process.

These and other objects have been achieved in accordance with the present invention by the method(s) described and claimed hereinafter. According to the invention, these objects are achieved in components of the aforementioned type by producing not only the above contours by continuous casting or extrusion from a metal alloy, particularly a light metal alloy, but also grooves that extend axially in the rotor in the vanes on the radially outward side and/or in the housing in the webs on the radially inward side, and axial through-holes 1.6-1.6''' for fasteners in the rotor housing 1 in the area of the webs 1.4-1.4'''. Furthermore, not only at least one of the component blanks is calibrated to the required dimensions, particularly the final dimensions, in a forming process using a die, but also at least four of the following countours:

- in the rotor, the grooves for seals that extend axially along the vanes on the radially outward side,
- in the rotor housing, the grooves for seals that extend axially in the webs on the radially inward inside,

- in the rotor, a channel-shaped or tunnel-shaped opening that extends at least approximately radially from one of the end faces in the area of one of the vanes and ends in front of the radially outward extent of the vane.
- in the rotor, a channel-shaped or tunnel-shaped opening that functions as an oil duct and extends in one of the webs at least approximately radially from one of the end faces and ends in front of the radial extent of the rotor housing.
- in the rotor housing, the axially extending openings for fasteners.

In a further aspect of the invention, a suitable method for producing a component of the above-mentioned type comprises producing a rotor and/or a rotor housing for a camshaft adjuster for motor vehicle engines, wherein the rotor with vanes extending radially outwardly from a rotor core engages in chambers of the rotor housing that are formed by webs extending radially inwardly from the outer housing wall toward the rotor core, and these contours of at least one of the components are produced from a continuous casting or an extruded part of a metal alloy, particularly a light metal alloy, wherein, in addition, grooves that extend axially in the rotor in the vanes on the radially outward side and/or in the housing in the webs on the radially inward side, and axial through-holes for fasteners in the rotor housing in the area of the webs are formed by continuous casting or extrusion and, thereafter, a) a component blank is produced by separating the continuous casting or the extruded part, and b) after separation, not only at least one of the component blanks is calibrated to the required final dimensions of the component in a forming process using a die, but also at least four of the following contours:

- in the rotor, the grooves for seals that extend axially in the vanes on the radially outward side,
- in the rotor housing, the grooves for seals that extend axially in the webs on the radially inward side,
- in the rotor, a channel-shaped or tunnel-shaped opening that functions as an oil duct and extends at least approximately radially from one of the end faces in the area of one of the vanes and ends in front of the radially outer extent of the vane, or:
- in the rotor housing, a channel-shaped or tunnel-shaped opening that functions as an oil duct and extends at least approximately radially in one of the webs from one of the end faces and ends in front of the radial extent of the rotor housing, the openings for fasteners.

However, according to yet another aspect of the invention, components of the above-mentioned type can also be characterized by a rotor and/or a rotor housing configuration for a camshaft adjuster for motor vehicle engines, wherein the rotor with vanes extending radially outwardly from a rotor core engages in chambers of the rotor housing that are formed by webs extending radially inwardly from the outer housing wall toward the rotor core, and these parts or contours, like the grooves that extend axially in the rotor in the vanes on the radially outward side and/or in the housing in the webs on the radially inward side and axial through-holes for fasteners in the rotor housing in the area of the webs, are produced by continuous casting or extrusion, particularly from a light metal alloy, and at least four of the following contours are calibrated to the required dimensions in a forming process using a die:

- in the component blanks, the rotor core with the radially outwardly extending vanes and/or in the rotor housing the inner contour with the radially inwardly extending webs, in the rotor, the grooves for seals that extend axially in the vanes on the radially outward side, in the rotor housing, the grooves for seals that extend axially in the webs on the radially inward side, in the rotor, a channel-shaped or tunnel-shaped opening that functions as an oil duct and extends at least approximately radially from one of the end faces in the area of the vanes and ends in front of the radial extent of the vane, or:

in the rotor, a channel-shaped or tunnel-shaped opening that functions as an oil duct and extends at least approximately radially in the area of one of the webs from one of the end faces and ends in front of the radial extent of the rotor housing, the openings for fasteners.

Such components can be produced in accordance with the invention by a method of producing a rotor and a rotor housing for a camshaft adjuster for motor vehicle engines, wherein the rotor with vanes extending radially outwardly from a rotor core engages in chambers of the rotor housing that are formed by webs extending radially inwardly from the outer housing wall toward the rotor core, and these contours, like the grooves that extend axially in the rotor in the vanes on the radially outward side and/or in the housing 1 in the webs on the radially inward side and axial through-holes for fasteners in the rotor housing 1 in the area of the webs, are produced by continuous casting or extrusion from a light metal alloy and, thereafter, a) a component blank is produced by separating the continuous casting or the extruded part, and b) after separation, at least one of the following contours is calibrated to the required final dimensions of the component in a forming process using a die:

in the rotor blanks, the rotor core with the radially outwardly extending vanes and/or in the rotor housing the inner contour with the radially inwardly extending webs, in the rotor, the grooves for seals that extend axially in the vanes on the radially outward side, in the rotor housing, the grooves for seals that extend axially in the webs on the radially inward side, in the rotor, a channel-shaped or tunnel-shaped opening that functions as an oil duct and extends at least approximately radially from one of the end faces in the area of at least one of the vanes and ends in front of the radially outer extent of the vane, or:

in the rotor housing, a channel-shaped or tunnel-shaped opening that functions as an oil duct and extends in one of the webs at least approximately radially from one of the end faces and ends in front of the radial extent of the rotor housing, the openings for fasteners.

BRIEF DESCRIPTION OF THE DRAWING

The invention will now be described in greater detail with reference to an illustrative embodiment shown in the accompanying drawing FIGURE, which is a cross-sectional view of a camshaft drive adjusting apparatus according to the present invention.

DETAILED DESCRIPTION OF PREFERRED EMBODIMENTS

The components 1 and 2 illustrated here include a housing 1, which accommodates a rotor 2. Both the housing 1 and the rotor 2 are arranged coaxially to a camshaft (not shown) or coaxially to the center axis 3 of the camshaft. The rotor 2 and the housing 1 are in operative engagement by means of radially extending surfaces 2.3, 1.3. By an adjustment mechanism (not shown), the relative angular position between the rotor 2 and the housing 1 is altered in reference to the center axis 3 during operation.

To this end, the rotor 2 has four vanes 2.2-2.2''' that extend from the rotor body 2*a* and are arranged within corresponding recesses or chambers 1.2-1.2''', which are formed between successive webs 1.4-1.4''' of the rotor housing 1. It is also feasible to provide a different number of vanes with corresponding recesses. On the radially outward side the vanes 2.2-2.2''' of the rotor 2, and on the radially inward side the webs 1.4-1.4''' of the housing 1, are each provided with axially extending grooves 2.5-2.5''' and 1.5-1.5''', respectively.

It may also be advantageous to form, again by calibrating, a channel-shaped or tunnel-shaped opening 2*c* in the end face 2*b* of one of the vanes, namely 2.2''' of the rotor 2, which opening extends at least approximately radially and ends before reaching the radially outward extent of the vane. On the radially inward side this opening ends in the central bore 2*d*. It is particularly advantageous to make this vane 2.2''' wider in circumferential direction than the other vanes and to design the chamber(s) accordingly. At least to that extent, the resulting design of the components is irregular.

According to a particularly advantageous further embodiment of the invention, through-holes for receiving fasteners, such as screws, are likewise produced by continuous casting or extrusion and subsequent calibration.

Important aspects in the production process are the dimensions of the vanes 2.2, the openings 2*c* and the grooves 1.5 and 2.5, which like the opening 2*c* can be shaped or calibrated to the final dimensions in a forming process using a die after continuous casting or extrusion and cutting to length.

It may also be advantageous, however, to form even the grooves 1.5 in the housing 1 and the grooves 2.5 in the rotor 2 to the final dimensions by continuous casting or extrusion and optionally to form only the opening 2*c* by calibration.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A rotor and rotor housing for a camshaft adjuster for a motor vehicle engine, comprising a rotor with vanes extending radially outwardly from a rotor core received in a rotor housing having webs extending radially inwardly from a housing wall toward the rotor core such that chambers are formed between successive webs in which the rotor vanes engage, the contours of the rotor or housing or both the rotor and the housing being produced from a continuous casting or an extruded part made of a metal alloy;

axially extending grooves in radially outward sides of said rotor vanes or in radially inward sides of said housing webs, or in both the radially outward sides of said rotor vanes and the radially inward sides of said housing webs, and axial through-holes in the webs of the rotor housing for receiving fasteners, being formed by continuous casting or extrusion, and wherein the rotor or the housing or both the rotor and the housing and at least four of the following contours are calibrated to required dimensions during the forming using a die:

in the rotor, the grooves for seals that extend axially in the vanes on the radially outward side, in the rotor housing, the grooves for seals that extend axially in the webs on the radially inward side, in the rotor, a channel-shaped or tunnel-shaped opening that functions as an oil duct and extends at least approximately radially from one of the end faces in the area of one of the vanes and ends before reaching the outer extent of the vane, or:

in the rotor housing, a channel-shaped or tunnel-shaped opening that functions as an oil duct and extends at least approximately radially in one of the webs from one of the end faces and ends before reaching the radial extent of the rotor housing web, and the through holes for fasteners.

2. An apparatus as claimed in claim 1, wherein said metal alloy is a light metal alloy.

3. A method of producing a rotor and a rotor housing for a camshaft adjuster for motor vehicle engines, wherein:

a rotor with vanes extending radially outwardly from a rotor core engages in chambers of a rotor housing that are formed by webs extending radially inwardly from an outer housing wall toward the rotor core;

the contours of at least one of the rotor and housing are produced from a continuous casting or an extruded part of a metal alloy;

axially extending grooves in radially outward sides of the rotor vanes or in radially inward sides of the housing webs, or both, and axial through-holes for fasteners in the area of the webs in the rotor housing are formed by continuous casting or extrusion; and thereafter, a) producing a component blank by cutting the continuous casting or extruded part, and b) after the cutting, calibrating at least one of the rotor and housing and at least four of the following contours to required final dimensions in a forming process using a die:

in the rotor, the grooves for seals that extend axially in the vanes on the radially outward side, in the rotor housing, the grooves for seals that extend axially in the webs on the radially inward side, in the rotor, a channel-shaped or tunnel-shaped opening that functions as an oil duct and extends at least approximately radially from one of the end faces in the area of one of the vanes and ends before reaching the radially outer extent of the vane, in the rotor housing, a channel-shaped or tunnel-shaped opening that functions as an oil duct and extends at least approximately radially in one of the webs from one of the end faces and ends before reaching the radial extent of the rotor housing, and the through holes for fasteners.

4. A method as claimed in claim 3, wherein said metal alloy is a light metal alloy.

5. A rotor and rotor housing for a camshaft adjuster for a motor vehicle engine, comprising a rotor with vanes extending radially outwardly from a rotor core received in a rotor housing having webs extending radially inwardly from a housing wall toward the rotor core such that chambers are formed between successive webs in which the rotor vanes engage, wherein:

the rotor and housing are produced by continuous casting or extrusion with axially extending grooves on radially outward sides of the vanes of the rotor and/or on radially inward sides of the webs of the housing, and with axial through-holes for fasteners in the area of the webs of the rotor housing; and at least four of the following contours are calibrated to the required dimensions in a forming process using a die:

in the rotor, the rotor core with the radially outwardly extending vanes, or in the rotor housing, the housing inner contour with the radially inwardly extending webs, or both, in the rotor, the grooves for seals that extend axially in the vanes on the radially outward side, in the rotor housing, the grooves for seals that extend axially in the webs on the radially inward side, in the rotor, a channel-shaped or tunnel-shaped opening that functions as an oil duct and extends at least approximately radially from one of the end faces in the area of the vanes and ends before reaching the radial extent of the vane, in the rotor housing a channel-shaped or tunnel-shaped opening that functions as an oil duct and extends at least approximately radially in the area of one of the webs from one of the end faces and ends before reaching the radial extent of the rotor housing, and the through-openings for fasteners.

6. An apparatus as claimed in claim 5, wherein the rotor and housing are produced from a light metal alloy.

7. A method of producing a rotor and a rotor housing for a camshaft adjuster for motor vehicle engines, wherein:

a rotor with vanes extending radially outwardly from a rotor core engages in chambers of a rotor housing that are formed by webs extending radially inwardly from an outer housing wall toward the rotor core;

the rotor and housing are produced by continuous casting or extrusion with axially extending grooves on radially outward sides of the vanes of the rotor and/or on radially inward sides of the webs of the housing, and axial through-holes for fasteners in the area of the webs of the rotor housing; and thereafter, a) producing a rotor or housing blank by cutting the continuous casting or the extruded part, and b) after the cutting, calibrating at least one of the following contours to required final dimensions in a forming process using a die:

in a rotor blank, the rotor core with the radially outwardly extending vanes, or in the rotor housing, the housing inner contour with the radially inwardly extending webs, or both, in the rotor, the grooves for seals that extend axially in the vanes on the radially outward side, in the rotor housing, the grooves for seals that extend axially in the webs on the radially inward side, in the rotor, a channel-shaped or tunnel-shaped opening that functions as an oil duct and extends at least approximately radially from one of the end faces in the area of at least one of the vanes and ends before reaching the radially outer extent of the vane, in the rotor housing, a channel-shaped or tunnel-shaped opening that functions as an oil duct and extends in one of the webs at least approximately radially from one of the end faces and ends before reaching the radial extent of the rotor housing, and the through-holes for fasteners.

8. A method as claimed in claim 7, wherein the rotor or the housing or both are produced by continuous casting or extrusion from a light metal alloy.

* * * * *